US006220373B1

(12) United States Patent
Woodings

(10) Patent No.: US 6,220,373 B1
(45) Date of Patent: Apr. 24, 2001

(54) DRILL ROD WITH AXIAL AIR PASSAGEWAY AND METHOD OF MAKING SAME

(76) Inventor: Robert T. Woodings, 4721 Bayard St., Pittsburgh, PA (US) 15213

( * ) Notice: Subject to any disclaimer, the term of this patent is extended or adjusted under 35 U.S.C. 154(b) by 0 days.

(21) Appl. No.: 09/391,116

(22) Filed: Sep. 7, 1999

(51) Int. Cl.[7] ..... E21B 17/18
(52) U.S. Cl. ..... 175/320; 175/57
(58) Field of Search ..... 175/57, 92, 99, 175/320, 65–72, 324; 173/78–80

(56) References Cited

U.S. PATENT DOCUMENTS

| | | | | |
|---|---|---|---|---|
| 3,978,931 | * | 9/1976 | Sudnishnikov et al. | 175/92 |
| 4,194,581 | * | 3/1980 | Walter | 175/92 |
| 4,321,974 | * | 3/1982 | Klemm | 175/92 |
| 4,625,814 | * | 12/1986 | Helasuo et al. | 175/57 |

* cited by examiner

*Primary Examiner*—Robert E. Pezzuto

(74) *Attorney, Agent, or Firm*—James Ray & Associates

(57) ABSTRACT

A low-cost drill rod for use with rotary-percussion drilling apparatus having a compressed air system for blowing compressed air through such a drill rod to purge drilling debris from a hole being drilled, wherein the drill rod comprises an elongated solid cylindrical steel bar having a first end threaded to permit attachment thereof, to the drilling apparatus, and a second end threaded to receive a drill bit, and having a tubular sleeve axially disposed around the cylindrical outer surface of the cylindrical steel bar to form an annular chamber between the steel bar and the tubular sleeve, the length of the tubular sleeve being insufficient to overlay the first and second threaded ends of the steel bar, and wherein a first end of the tubular sleeve adjacent to the first end of the steel bar is joined to the surface of the steel bar to seal a first end of the annular chamber, and including an aperture through a side wall of the steel bar under the tubular sleeve and adjacent to the sealed end of the annular chamber, with the aperture communicating between the first end of the steel bar and the annular chamber, such that compressed air applied at the first end of the steel bar will pass therefrom, and exit through the annular chamber adjacent to the threaded second end of the steel bar.

9 Claims, 1 Drawing Sheet

DRILL ROD WITH AXIAL AIR PASSAGEWAY AND METHOD OF MAKING SAME

FIELD OF THE INVENTION

This invention relates generally to rock drilling and more particularly to drilling with rotary-percussion drilling apparatus, and is specifically addressed to a low-cost drill rod for use with rotary-percussion drilling apparatus utilizing a compressed air system to blow drilling debris from the hole being drilled. In a narrower sense this invention relates to the art of opening tap holes in shaft furnaces such as a blast furnace and to blast furnace tap hole drills, and particularly to a new and unique, low cost, easy to manufacture, drill rod for use with such shaft furnace tap hole drills, or any drilling procedure utilizing compressed air blown through the drill bit.

BACKGROUND OF THE INVENTION

It is well known that the hearth of an iron blast furnace is provided with a tap hole, commonly referred to as an "iron notch" through which molten iron, usually referred to as "hot metal", is drawn off at periodic intervals during a blast furnace campaign. During a normal campaign, such tapping must be done an average of five to twelve times daily, as the blast furnace hearth becomes filled with molten iron (i.e., hot metal) and molten slag. After the blast furnace has been tapped, i.e. the molten hot metal and slag drained therefrom, the tap hole, or iron notch, is plugged with clay or "mud" which will harden and seal to tap hole until the next time the blast furnace is tapped.

In accordance with conventional practices, a special drill is often utilized to open the tap hole, i.e., drill a passageway through the hardened clay plugging the iron notch, for purposes of tapping the blast furnace. Such blast furnace tap hole drills are normally pneumatically or hydraulically operated rotary-percussion drills comparable to rock drills utilized in the mining industry. Such drills impart both a rotary and an impact force on an elongated drill rod having a rock drill bit at the end thereof, which is disposed against the iron notch, and normally includes a compressed air system for blowing compressed air through the center of the drill bit and drill rod assembly to purge drilling debris from the drilled hole. Typical operations usually utilize a four-wing drill bit having an axial air passage through which compressed air is blown, with the drill bit attached to an elongated drill rod (typically at least about 10 feet in length) having an air passageway drilled throughout the full axial length thereof.

The base support for the blast furnace tap hole drill is normally secured to the floor, a structural column or some solid base structure in the vicinity of the blast furnace iron notch, and is provided with suitable linkage members and remote controls so that the blast furnace tap hole drill can be remotely operated to move the drill into proper position for drilling the tap hole, then operated to drill the tap hole, and thereafter moved back away from the tap hole and the heat of the emerging hot metal, where the drill can be serviced and prepared for the next tap.

To prepare the blast furnace tap hole drill for each succeeding tap, it is always necessary to replace the drill bit, if not the entire drill bit and drill rod assembly to which the drill bit is secured. This is because the temperature of the blast furnace hot metal, being about 2700–2800° F., severely erodes the drill bit after it drills through the clay plug and enters the bath of molten hot metal. In addition, once the tap hole is drilled, the ferrostatic head of hot metal, within the blast furnace, will cause hot metal to emerge through the tap hole around the drill bit and drill rod before the drill rod and bit can be safely withdrawn from the tap hole. Oftentimes, the drill bit and drill rod will not only be severely eroded, but portions of the drill bit remaining may virtually be "welded" to the end of the drill rod to which it had previously been removably attached. In such event, it may be impossible to remove the drill bit from the drill rod to replace a new drill bit, and accordingly, it usually becomes necessary to replace the entire assembly, i.e., drill bit and adjoining drill rod or drill rod component to which the drill bit becomes welded. Accordingly, the expense associated with such a result is normally rather excessive when considering not only the cost of the replacement drill bit, but also the cost of the replacement drill rod, both of which are normally beyond salvage and must be discarded. Indeed, such drill rods, as necessary for tapping shaft furnaces, such as a blast furnace, are rather costly to produce in that they must be good quality steel of exceptional length, and must have an air hole drilled through the full length. Accordingly, the art is not only in need of a lower cost drill bit, but also in need of a lower cost drill rod, one in which the costly need to drill an elongated, axial air passageway can be eliminated or reduced.

SUMMARY OF THE INVENTION

The present invention is predicated upon the conception and development of a new and unique low-cost drill rod which is easily and cheaply manufactured by eliminating the need to drill an axial air passageway therethrough, and which can, therefore, be discarded after a single use, if necessary, without concern for the cost thereof.

In essence, in it's simplest form, the unique new drill rod of this invention comprises an elongated, solid cylindrical steel bar having a first end threaded to permit attachment thereof, to the drilling apparatus, and a second end threaded to receive a drill bit. A tubular sleeve, also preferably made of steel, is axially disposed over and around the cylindrical outer surface of the cylindrical bar to form an annular chamber between the steel drill rod and tubular sleeve. The length of the tubular sleeve is not sufficient to overlay the first and second threaded ends of the steel bar. A first end of the tubular sleeve adjacent to the first end of the steel bar is joined, for example, by welding or the like, to the surface of the steel bar to seal the first end of the annular chamber. An aperture is provided through a side wall of the steel rod under the tubular sleeve and adjacent to the sealed end of the annular chamber, so that the aperture provides communication between the first end of the steel bar and the interior of the annular chamber. Accordingly, compressed air applied at the first end of the steel bar will pass therefrom and into the annular chamber, and exit at the far end of the annular chamber, adjacent to the threaded second end of the steel bar. The result, of course, is that the elongated air passageway, normally provided by a rather expensive drilling technique through the elongated axial length of the drilling rod, is in part replaced by the annular chamber provided between the steel bar and the tubular sleeve disposed thereover.

OBJECTS OF THE INVENTION

It is, therefore, a primary object of the present invention to eliminate or lower the cost of producing elongated drill rods having airways therethrough.

It is another primary object of this invention to eliminate the cost of drilling an elongated hole throughout the length of an elongated drill rod.

It is still another primary object of this invention to lower the cost of blast furnace tap hole drilling by utilizing a low-cost drill rod.

It is a further object of the present invention to provide a unique low-cost drill rod for use with rotary-percussion drilling apparatus having a compressed air system for blowing compressed air through such a drill rod, whereby, the expense of drilling an elongated hole through the axis of the drill rod is eliminated.

It is a still further object of the present invention to provide a unique low-cost drill rod for use with a blast furnace tap hole drill having a compressed air system for blowing compressed air through such a drill rod to purge drilling debris from the tap hole being drilled, whereby, the expense of drilling an elongated hole through the axis of the drill rod is eliminated.

An even further object of this invention is to provide a new and unique drill rod for use with rotary-percussion drilling apparatus having a compressed air system for blowing compressed air through such a drill rod to purge drilling debris from a hole being drilled, wherein an air passageway is provided through the length of the drill rod by an annular chamber disposed between the surface of the drill rod and a tubular sleeve secured over the surface of the drill rod.

An even additional object of this invention is to provide a new and unique drill rod for use in blast furnace tap hole drilling apparatus having a compressed air system for blowing compressed air through such a drill rod to purge drilling debris from the tap hole being drilled, wherein, an air passageway is provided through the length of the drill rod by an annular chamber disposed between the surface of the drill rod and a tubular sleeve secured over the surface of the drill rod.

It is a still further object of the present invention to provide a unique low-cost drill rod for use with rotary-percussion drilling apparatus having a compressed air system for blowing compressed air through such a drill rod, wherein, the drill rod comprises an elongated solid cylindrical steel bar having a first end threaded to permit attachment to the drilling apparatus, and a second end threaded to receive a drill bit, and having a tubular sleeve axially disposed over and around the cylindrical outer surface of the cylindrical steel rod to form an annular chamber between the steel rod and the tubular sleeve, the length of the tubular sleeve being insufficient to overlay the first and second threaded ends of the steel bar, with a first end of the tubular sleeve adjacent to the first end of the steel bar being joined to the surface of the steel bar to seal a first end of the annular chamber, and further having an aperture through a side wall of the steel rod under the tubular sleeve and adjacent to the sealed end of the annular chamber, such that the aperture communicates between the first end of the steel bar and the annular chamber, so that compressed air applied at the first end of the steel bar will pass therefrom, and exit through the annular chamber adjacent to the threaded second end of the steel bar.

A further object of this invention is to provide a new and unique drill rod for use with blast furnace tap hole drills having a compressed air system for blowing compressed air through such a drill rod to purge drilling debris from the tap hole being drilled, wherein, an air passageway is provided through the drill rod by an annular chamber disposed between the surface of the drill rod and a tubular sleeve secured over the surface of the drill rod.

These and other objects and advantages of this invention will be realized from a full understanding of the following detailed description, particularly, when read in conjunction with the attached drawings, as described below.

DESCRIPTION OF A PREFERRED EMBODIMENT OF THE INVENTION

Figure 1:
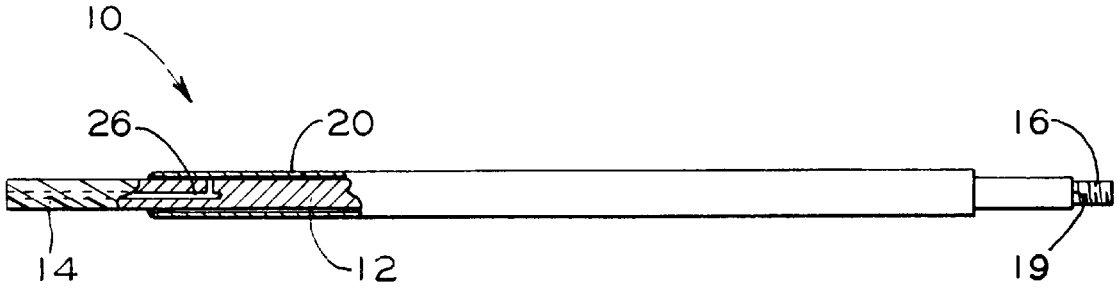
FIG. 1 is an elevational and cross-sectional side view of a drill rod in accordance with a presently preferred embodiment of this invention.

Referring now to the drawings, FIG. 1 illustrates in cross section, an elongated side view of a presently preferred embodiment of the unique drill rod 10 of this invention, which comprises an elongated and solid cylindrical steel bar 12, of predetermined length having a threaded first end 14 for attachment to a rotary-percussion drilling apparatus, and also having a second threaded end 16 to which a drill bit (not shown) can be attached. While the threading sizes and parameters of the two ends 14 and 16 are not particularly critical for the purposes of this invention, obviously, they should be as required for their respective function with regard to prior art drill rods. For example, in accordance with conventional prior art practices, the first threaded end 14 is normally provided with a quick-change type of heavy threading such as "rope" threading, while the second threaded end 16 must of course, be threaded as necessary to receive whatever drill bit is intended to be used.

A tubular sleeve 20, which is also preferably fabricated of steel, is axially positioned over the outer surface of steel bar 12 to form an annular chamber 22 between the outer cylindrical surface of steel bar 12, and inner cylindrical surface of tubular sleeve 20, disposed thereover. The length and position of tubular sleeve 20 should be such that it does not overlay the two threaded ends of steel bar 12, so that at a first end of tubular sleeve 20, namely that end adjacent to the first threaded end 14 of steel bar 12 which is threaded for attachment to a rotary percussion drilling apparatus, is joined to the adjacent surface of steel bar 12, by welding 18, for example, to thereby close that end of annular chamber 22. The opposite end of annular chamber 22 is not closed at all, but rather that second end of tubular sleeve 20 is intentionally left as a sleeve spaced from the outer cylindrical surface of steel bar 12.

Figure 2:
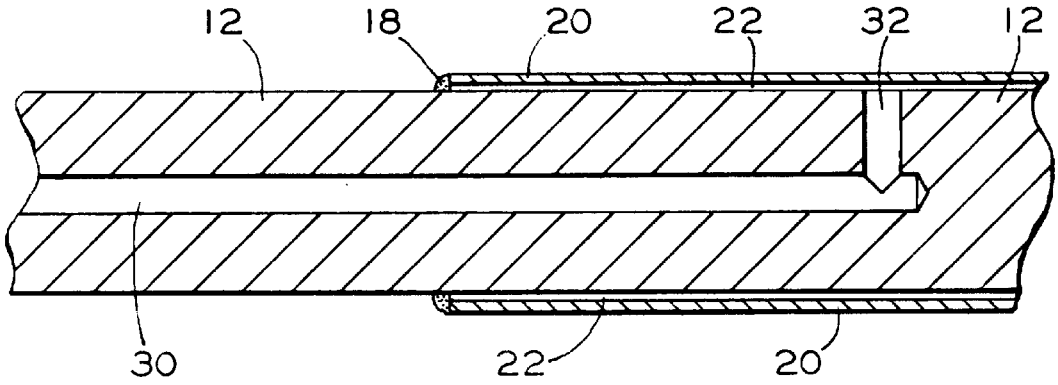
FIG. 2 is an enlarged cross-sectional view of the first end of the drill rod illustrated in FIG. 1.

An aperture 26 is provided through a side wall of steel bar 12 under the overlaying tubular sleeve 20 which is adjacent to the sealed end of the annular chamber 22, such that the aperture 26 will communicate between the first end of steel bar 12 and the annular chamber 22, so that compressed air applied at the first end 14 of the steel bar 12 will pass therefrom, and into annular chamber 22, and exit from annular chamber 22 through the opening provided between steel bar 12 and tubular sleeve 20 adjacent to the threaded second end 16 of said steel bar 12. As shown in greater detail in FIG. 2, aperture 26 can be provided by drilling an axial hole 30, to intersect with radial hole 32.

As should be apparent from the above description, the steel bar 12 is provided with an air passageway entirely therethrough, which initially comprises the aperture 26 and is completed by annular chamber 22. A similar aperture to aperture 26 is not in fact necessary at or near the threaded second end 16, as the air exiting at the end of annular chamber 22 will normally be close enough to drill bit (not shown) to achieve the desired purging action at the base of the drilled hole without any need to reintroduce such air back into the axis of steel bar 12.

Figure 3:
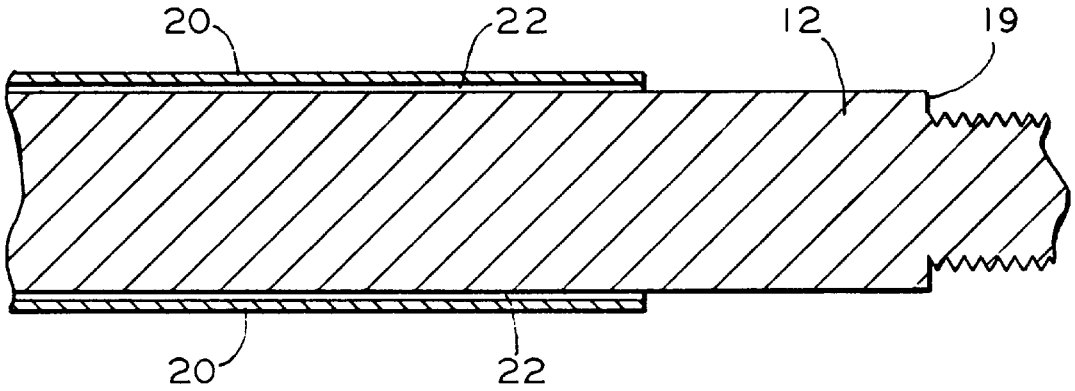
FIG. 3 an enlarged cross-sectional view of the second end of the drill rod illustrated in FIGS. 1 and 2.

To provide a specific example of the above drill rod 10 for one successful embodiment, a 12-foot length of 1⅜-inch steel bar of 1045 grade steel was utilized, with the first threaded end 14 machined to provide a 4.75-inch length rope threading, and the second threaded end 16 machined to receive a drill bit having a conventional one-inch socket. As shown in FIGS. 1 and 3, the base of the threaded portion is provided with a shoulder 19 against which the drill bit (not shown) should be seated.

To provide aperture 26, a ½-inch axial hole 30 was drilled into the first end of steel drill rod 10 while ½-inch radial hole 32 was drilled through the wall of drill rod 10 positioned to intersect the drilled axial hole 30.

The tubular sleeve 20 was provided by a length of 1⅝-inch 304 stainless steel tubing having an overall length of 135 and ¾ inches. Welding was effected by MIG welding using a 1/16-inch wire to achieve a ¼-inch weld.

While one rather specific embodiment of this invention has been described above, it should be apparent that other embodiments and modifications could be utilized or incorporated without departing from the spirit of the invention. For example, aperture 26 could be provided with a single drilled hole diagonally disposed from a side surface of steel bar 10 to the end 14. In addition, while it has not been found necessary to do so, spacer elements could be provided between the outer surface of steel bar 10 and tubular sleeve 20.

I claim:

1. A low-cost drill rod for use with rotary-percussion drilling apparatus having a compressed air system for blowing compressed air through such drill rod to purge drilling debris from a hole being drilled, said drill rod comprising an elongated solid steel bar having at least one side wall and a first end threaded to permit attachment thereof to said drilling apparatus, and a second end threaded to receive a drill bit, a tubular sleeve axially disposed around said steel bar to form a chamber between said steel bar and said tubular sleeve, the length of said tubular sleeve being insufficient to overlay the first and second threaded ends of said steel bar, a first end of said tubular sleeve adjacent to said first end of said steel bar being joined to said steel bar to seal a first end of said chamber, and an aperture through said at least one side wall under said tubular sleeve and adjacent to said sealed end of said annular chamber, said aperture communicating between said first end of said steel bar and said chamber, such that compressed air applied at said first end of said steel bar will pass therefrom and exit through said chamber adjacent to said threaded second end of said steel bar.

2. A low-cost drill rod for use with rotary-percussion drilling apparatus, according to claim 1, wherein said steel bar and said tubular sleeve are cylindrical and the chamber formed therebetween is an annular chamber.

3. A low-cost drill rod for use with rotary-percussion drilling apparatus, according to claim 1, wherein said aperture is formed by an axial hole in said first end of said steel rod in communication with a substantially radial hole through said at least one side wall of said steel rod.

4. A low-cost drill rod for use with rotary-percussion drilling apparatus, according to claim 1, wherein said first end of said tubular sleeve is joined to the surface of said steel bar by forming an air-tight welded joint at the interface between said steel rod and the adjacent outer edge of said steel sleeve.

5. A low-cost drill rod for use with rotary-percussion drilling apparatus, according to claim 1, wherein said tubular sleeve is a stainless steel sleeve.

6. A method of making a low-cost drill rod for use with rotary-percussion drilling apparatus having a compressed air system for blowing compressed air through such drill rod to purge drilling debris from a hole being drilled, said method comprising:

a. threading a first end of an elongated solid steel bar to permit attachment, thereof, to said drilling apparatus;

b. threading a second end of said steel bar to permit attachment of a drill bit;

c. providing an aperture through said steel bar communicating between a side surface of said steel bar and said first end of said steel bar;

d. placing a tubular sleeve axially around an outer surface of said steel bar to form an annular chamber between said steel bar and said tubular sleeve, the length of said tubular sleeve being insufficient to overlay the first and second threaded ends of said steel bar;

e. joining a first end of said tubular sleeve adjacent to said first end of said steel bar to seal a first end of said annular chamber.

7. A method of making a low cost drill rod, in accordance with claim 6, wherein said aperture is formed by drilling an axial hole into said first end of said steel bar which intersects with a radial hole drilled into a side of said steel bar.

8. A method of making a low cost drill rod, in accordance with claim 6, wherein said first end of said tubular sleeve is joined to the surface of said steel bar by providing an air-tight welded joint therebetween.

9. A method of making a low cost drill rod, in accordance with claim 6, wherein said tubular sleeve is a stainless steel sleeve.

* * * * *